United States Patent [19]

Kim

[11] 3,990,701

[45] Nov. 9, 1976

[54] TENNIS RACKET

[76] Inventor: Sung Baik Kim, 32-32 82nd St., Jackson Heights, N.Y. 11372

[22] Filed: Nov. 26, 1974

[21] Appl. No.: 527,194

[52] U.S. Cl. ..... 273/73 C; 273/73 D; 273/73 G; 273/73 K

[51] Int. Cl.[2] ..... A63B 49/02

[58] Field of Search ..... 273/73 R, 73 C, 73 D, 273/73 F, 73 H, 73 K

[56] References Cited

UNITED STATES PATENTS

| | | | |
|---|---|---|---|
| 1,381,050 | 6/1921 | Agutter | 273/73 K |
| 1,508,286 | 9/1924 | Moore | 273/73 K |
| 1,636,867 | 7/1927 | Robinson | 273/73 K |
| 1,937,787 | 12/1933 | Robinson | 273/73 H |
| 2,274,788 | 3/1942 | Hatton | 273/73 K |
| 2,742,289 | 4/1956 | Allward | 273/73 H |
| 3,083,968 | 4/1963 | Takahashi | 273/73 R |
| 3,642,283 | 2/1972 | Wilkens | 273/73 D X |
| 3,814,423 | 6/1974 | Shockley et al. | 273/73 K X |

FOREIGN PATENTS OR APPLICATIONS

| | | | |
|---|---|---|---|
| 122,823 | 11/1946 | Australia | 273/73 H |
| 800,262 | 4/1936 | France | 273/73 H |
| 1,442,020 | 5/1966 | France | 273/73 D |
| 1,582,080 | 8/1969 | France | 273/73 D |
| 1,113,707 | 5/1968 | United Kingdom | 273/73 D |
| 1,122,895 | 8/1968 | United Kingdom | 273/73 F |
| 1,126,438 | 9/1968 | United Kingdom | 273/73 C |

*Primary Examiner*—Richard J. Apley
*Attorney, Agent, or Firm*—Natter & Natter

[57] ABSTRACT

A unitary tennis racket frame is formed of a relatively strong, e.g. metal, skeleton and a molded high impact thermoplastic. The skeleton serves as a mold core for the plastic and includes a generally U shaped outwardly facing channel having a plurality of oversized string holes in the bow. The mold for the composite racket includes a plurality of movable core pins which extend into the cavity in registry with the skeleton string holes. The plastic is injection molded into the cavity and around the pins which, when retracted, form the string holes.

10 Claims, 6 Drawing Figures

TENNIS RACKET

SUMMARY OF THE INVENTION

For many years conventional tennis rackets have been formed using wood as the basic material for the racket. However, wood rackets have been proven to have certain deficiencies as to durability, warping, and abrasiveness. To overcome these deficiencies, several types of metal rackets have been attempted, using extruded aluminum bars. While such construction improved the durability, warping and abrasiveness, these rackets have brought shortcomings affecting in the play characteristics of the racket. The extra stiffness in its longitudinal bending property caused the user's arm to be exposed to a high shock load which was not only uncomfortable, but which also lead to the well-known "tennis elbow". Another problem encountered with metal rackets was the difficulty in properly stringing the racket without exposing the strings to sharp edges which cut the strings.

In order to overcome the deficiencies of the wood rackets, and the metal rackets, several kinds of rackets have been constructed using a combination of metal and wood or metal and plastics. While these rackets improved the deficiencies of wood rackets and metal rackets as far as durability, warping, abrasiveness and play characteristics, because of the sophisticated and complicated process of manufacturing, the prices of these rackets were high, in some cases, beyond the reach of the general public. Furthermore, because some of these rackets were laminated, many latent defects were encountered.

The present invention not only overcomes the deficiencies of the known racket constructions just discussed, but also improves the quality and the manufacturing is very simple, thereby reducing the cost of rackets and making it more easily accessible to public users. In a preferred embodiment of the invention, a mold in the shape of the tennis racket for surface framing is constructed. With the known method of die-casting practiced for the last decades, the frame skeleton, which is formed as a "U" shaped channel, is molded, using magnesium alloy, or other light metal or even a graphite reinforced plastic. The molded racket frame will assure durability, anti-warping, and abrasive resistance, yet provides sufficient torsional rigidity.

The composite racket is then injection molded using the skeleton as an insert for a charge of thermoplastic which fills and encases the U channel, thus completing the racket frame. Because the composite racket is injection molded with the plastic encasing and interlocking the skeleton, a solid unit is provided and latent defects such as those encountered with laminated rackets are obviated.

The composite injection molded racket utilizes the beneficial characteristics of both the yieldable high impact plastic and the stiffer skeleton such that a desirable degree of longitudinal flexibility is provided by the plastic while torsional rididity is provided by the skeleton.

In injection molding the composite racket frame, the mold is equipped with sliding core pins in registry with the oversized openings in the skeleton bow to thereby provide stringing holes in the plastic section registered with the oversized holes in the skeleton.

In the accompanying drawings in which is shown one of the various possible embodiments of the invention:

Figure 1:
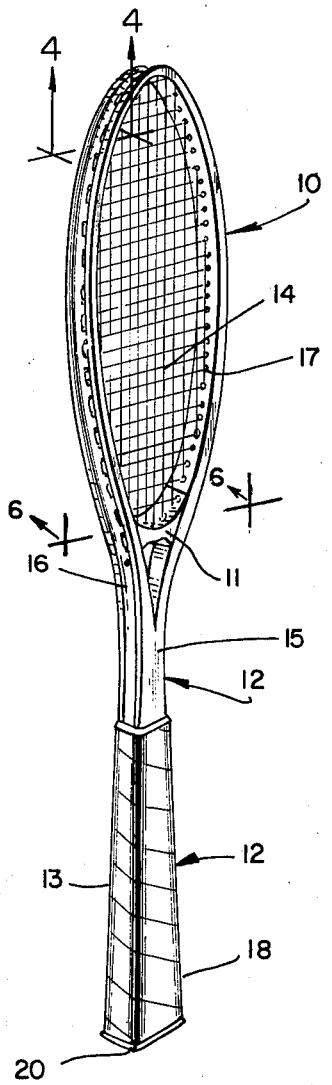
FIG. 1 is a perspective view of a strung racket constructed in accordance with the invention.
Figure 2:
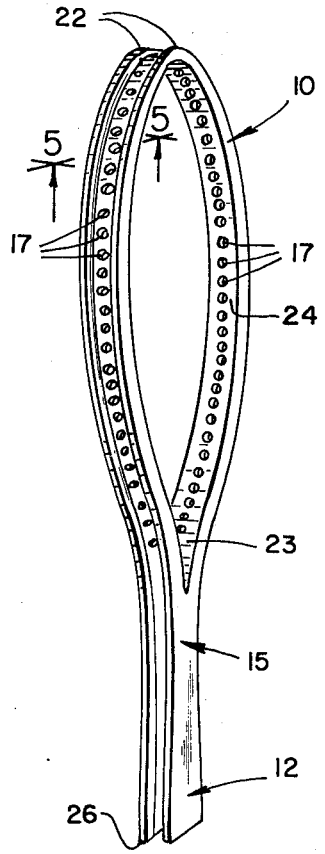
FIG. 2 is a perspective view of the skeleton of the racket frame which may be diecasted in magnesium alloy.
Figure 3:
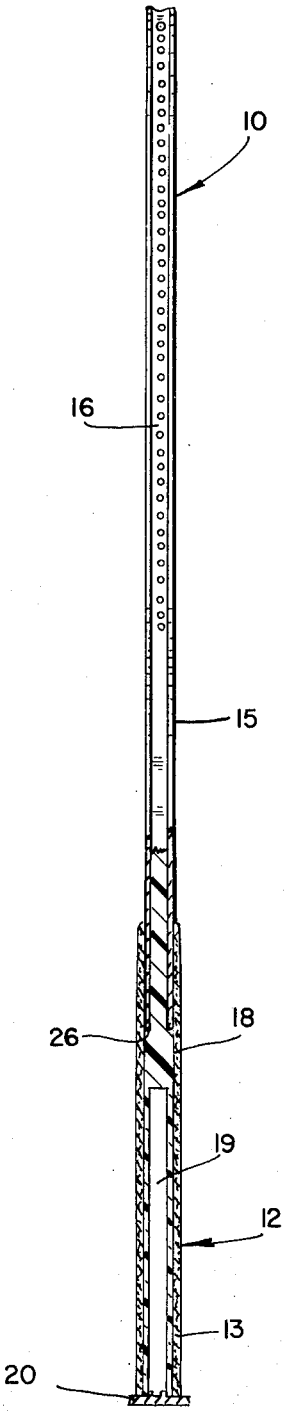
FIG. 3 is a side view of a racket constructed in accordance with the invention with the handle portion shown in cross section.
Figure 4:
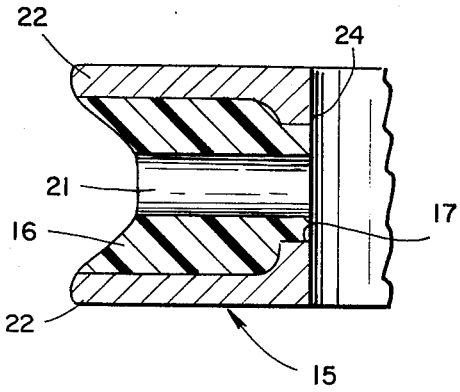
FIG. 4 is enlarged sectional view through the composite racket bow, with the strings deleted for clarity taken along plane of 4—4 FIG. 1.
Figure 5:
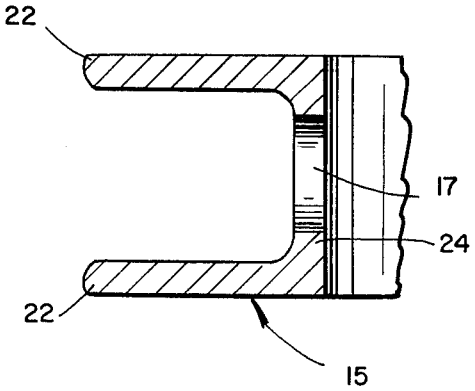
FIG. 5 is enlarged sectional view taken along plane 5—5 of FIG. 2, showing the "U" shape of the skeleton with larger string.

Referring now to the drawings, the invention will be described in detail.

The racket of the present invention includes a composite frame having a generally oval bow 10 which is joined to a stem 12 at a bridge 11. The stem 12 includes a handgrip 13, which may be typically bound with leather 18 or other suitable covering.

In accordance with the invention, the racket frame is of composite structure unitarily formed of a generally rigid skeleton 15, which serves as a mold core for a molded high impact plastic body 16. The composite frame structure provides a desirable degree of longitudinal flexibility while maintaining requisite torsional rigidity for optimum playing characteristics. A matrix of strings 14 spans the bow 10 extending through string holes which are formed during the novel molding process of the present invention.

The skeleton 15 is formed of a relatively stiff material such as a lightweight metal, e.g. aluminum, magnesium alloy, or a graphite impregnated reinforced plastic, and includes a generally U shaped transverse cross section which is outwardly facing in the bow area 10 having a pair of parallel flanges 22 projecting from opposite edges of a central web 24. Between the flanges the web is formed with oversized string holes 17. Typically, the skeleton 15 may be die cast of metal such as aluminum or magnesium alloy. It should be appreciated that in the stem area 12 the skeleton 15 is of generally H shaped transverse cross section with the opposed webs 24 in back to back orientation.

The skeleton 15 is placed in a mold to serve as a core for the composite frame, and in accordance with the invention the area between the flanges 22 and the web is substantially filled with an injection molded high impact plastic body 16. The mold includes a plurality of movable core pins which extend through the oversized string holes 17 of the skeleton 15, and the core pins are retracted after the charge of plastic 16 has cooled to form the actual string holes 21 for the string matrix 14.

It should be appreciated that to provide protection against string abrasion about the periphery of the bow 10, the plastic 16 is recessed so that it lies well beneath the width of the flanges 22.

Figure 6:
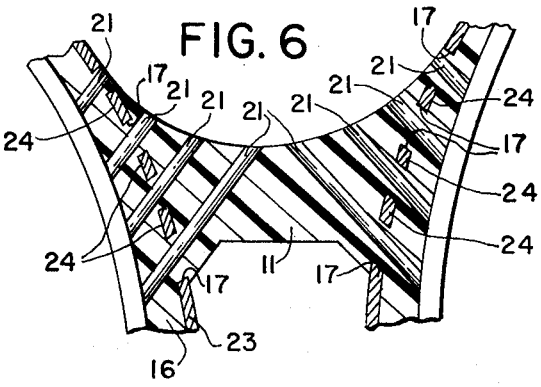
FIG. 6 is an enlarged fragmentary longitudinal cross section through the throat of the racket, the same being taken substantially along the plane 4—4 of FIG. 1, with the strings omitted for clarity, and showing in detail a bridge extending across the throat.

It should further by appreciated that in the area of the bridge 11 the plastic is molded in one piece with the plastic body 16 to extend as a bridge across a throat 23 of the skeleton 15 as shown in FIG. 1. As shown in FIG. 6 the string holes 21 through the bridge 11 of the throat 23 extend angularly from the bow periphery to the web. Thus, the racket frame may be conventionally strung.

The racket grip 13 extends beyond an end 26 of the stem 12 of the skeleton 15 and is part of the one piece plastic body 16. To provide desired weight adjustment a hollow area 19 is molded into the grip 13 and a plug 20 is inserted at the base of the grip. The plug 20 is selected of several plugs having different weights to provide weight adjustment for the individual user.

The composite injection molded racket frame is a unitary interlocking structure with the plastic 16 extending between the flanges 22 into the oversized string holes 17, through the string holes 17 to form the throat bridge, and also below the end 26 of the stem 12. The overall frame structure provides strength yet sufficient flexibility to reduce playing fatigue.

Thus, it will be seen that there is provided a tennis racket which achieves the various objects of the invention and which is well suited to meet the conditions of practical use.

As various changes might be made in the racket as above set forth, it is to be understood that all matter herein described or shown in the accompanying drawings is to be interpreted in an illustrative and not in a limiting sense.

What is claimed is:

1. A projectile striking racket comprising a one piece frame skeleton having a generally oval bow with one end being rounded and the opposite end comprising an open converging throat, and a stem interconnecting the bow at the throat, the transverse cross sectional area of the skeleton being of generally U-shaped configuration including a pair of spaced parallel flanges, each of the flanges extending from a central transverse web, means forming a plurality of spaced circular apertures through the web in the bow and throat, the racket further including a one piece plastic section, the plastic section being molded between the flanges, a portion of the plastic section extending into each of the circular apertures, a further portion of the plastic section extending through selected circular apertures across the throat and being spaced from the stem to form a bridge, and means forming a plurality of string holes transversely through the plastic section, each string hole being located at a portion of the plastic section which corresponds to each of said spaced circular apertures, whereby a unitary racket frame is provided with a desired degree of longitudinal flexure, yet with sufficient torsional rigidity and with each string hole peripherally supported by the frame web.

2. A game racket constructed in accordance with claim 1 wherein each string hole is substantially concentric with its respective circular aperture.

3. A game racket constructed in accordance with claim 1 further including a string matrix, the matrix including a plurality of string reaches extending across the bow, each string reach extending through a string hole in the plastic section.

4. A game racket constructed in accordance with claim 1 wherein the skeleton is constructed of a lightweight metal.

5. A game racket constructed in accordance with claim 4 wherein the metal is aluminum.

6. A game racket constructed in accordance with claim 4 wherein the metal is a magnesium alloy.

7. A game racket constructed in accordance with claim 1 wherein the skeleton is constructed of a graphite reinforced plastic.

8. A game racket constructed in accordance with claim 1 wherein the plastic section is formed of a low density injection moldable plastic.

9. A game racket constructed in accordance with claim 8 wherein the plastic is a thermoplastic.

10. A game racket constructed in accordance with claim 9 wherein the thermoplastic is polypropylene.

* * * * *